US008511123B2

(12) United States Patent
Scoville et al.

(10) Patent No.: US 8,511,123 B2
(45) Date of Patent: Aug. 20, 2013

(54) WEDGE DRIVEN PIPE BENDING MACHINE

(75) Inventors: Jeffrey C. Scoville, Broken Arrow, OK (US); Timothy R. Gwartney, Jenks, OK (US); Stephen Sears, Broken Arrow, OK (US)

(73) Assignee: CRC-Evans Pipeline International, Inc., Houston, TX (US)

( * ) Notice: Subject to any disclaimer, the term of this patent is extended or adjusted under 35 U.S.C. 154(b) by 403 days.

(21) Appl. No.: 12/777,056

(22) Filed: May 10, 2010

(65) Prior Publication Data

US 2011/0271734 A1 Nov. 10, 2011

(51) Int. Cl.
*B21D 7/10* (2006.01)

(52) U.S. Cl.
USPC ..... 72/31.04; 72/31.05; 72/149; 72/150; 72/155; 72/217

(58) Field of Classification Search
USPC ..... 72/31.04, 31.05, 149, 150, 155, 217
See application file for complete search history.

(56) References Cited

U.S. PATENT DOCUMENTS

| | | | | |
|---|---|---|---|---|
| 1,873,939 | A * | 8/1932 | Mason et al. | 72/157 |
| 3,335,588 | A * | 8/1967 | Cummings | 72/28.1 |
| 3,808,856 | A * | 5/1974 | Lance | 72/14.8 |
| 3,834,210 | A * | 9/1974 | Clavin et al. | 72/308 |
| 4,155,239 | A * | 5/1979 | Fjallstrom et al. | 72/218 |
| 6,164,113 | A * | 12/2000 | Parker | 72/307 |
| 6,253,595 | B1 * | 7/2001 | Lewis, Jr. | 72/369 |
| 6,298,706 | B1 * | 10/2001 | Dunn | 72/369 |
| 6,854,311 | B2 * | 2/2005 | Schmauder et al. | 72/157 |

* cited by examiner

*Primary Examiner* — Dana Ross
*Assistant Examiner* — Onekki Jolly
(74) *Attorney, Agent, or Firm* — Gable Gotwals

(57) ABSTRACT

A pipe bending machine has a stiff-back which is driven by a pivoting wedge. A linkage applies force from the actuator to the wedge in a direction parallel to a longitudinal axis of the stiff-back. The stiff-back pivots on a first fulcrum and the wedge slides on a bed which pivots on a second fulcrum. The actuator drives the wedge between the stiff-back and the bed to rotate the stiff-back at the first fulcrum and bend the pipe seated in the stiff-back against the pipe bending face of a die. The conversion of the longitudinal force applied to the wedge into a transverse force applied to the stiff-back provides a significant mechanical advantage which varies directionally as the stiff-back rotates about its fulcrum to maintain a constant force on the stiff-back.

4 Claims, 7 Drawing Sheets

WEDGE DRIVEN PIPE BENDING MACHINE

BACKGROUND OF THE INVENTION

This invention relates generally to pipe bending equipment and more particularly concerns machines used to bend steel pipe.

Known pipe bending machines level a pipe against a die with a pin-up located on one side of the die and apply force to the pipe on the other side of the die with a stiff-back, typically powered by hydraulic cylinders, to bend the pipe against the die. The maximum bend typically totals 15-16° and the total is achieved by sequential pulls. In each pull, the pipe is bent approximately ½°. Each pull results in a plastic deformation of the pipe. The cylinders of known machines apply the force directly to the stiff-back. Therefore, known machines generally require large diameter cylinders capable of generating forces in a range of 750,000 pounds. Typically, the cylinders required are in the range of 9-14" in diameter. Such a requirement imposes serious limitations on capabilities of the machine.

First, the larger the diameter of the cylinder, the greater will be the likelihood of leakage and other defects in cylinder operation. Second, the maximum industry standard cylinder is 8" in diameter. Therefore, cylinders for this application are currently custom made, usually at two to three times the cost of standard cylinders. Third, even though the custom cylinders are very large, known machines still require the use of tandem cylinders tied together. In this configuration, changes in cylinder orientation occur as the cylinders rotate in slightly different radii. This results in the cylinders competing with each other, reducing the net bending force available. In the worst such cases, the counteracting cylinders may bind. Fourth, the resulting reduced cylinder diameter to stroke ratio can cause the stiff-back to overshoot the intended bending angle of the pipe due to reduced controllability.

It is, therefore, an object of this invention to provide a pipe bending machine that will operate efficiently with standard size cylinders. Another object of this invention is to provide a pipe bending machine in which cylinders are not tied in a possibly competing configuration. It is also an object of this invention to provide a pipe bending machine that reduces the risks of overshooting intended bending angles.

SUMMARY OF THE INVENTION

In accordance with the invention, a pipe bending machine has a stiff-back which is driven by a pivoting wedge to provide a significant mechanical advantage against the stiff-back as the stiff-back rotates about its fulcrum.

The pipe bending machine employs a die, a trough pivoted on a first fulcrum, a bed pivoted on a second fulcrum, a wedge disposed between the trough and the pivoted bed and an actuator driving the wedge between the trough and the bed to bend a pipe seated in the trough against the die. Preferably, a linkage applies force from the actuator to the wedge in a direction parallel to a longitudinal axis of the trough.

Preferably, the die is fixed. The trough is pivoted on a first fulcrum about a first axis parallel to a pipe bending face of the die and perpendicular to a longitudinal axis of the pipe. The bed is pivoted on a second fulcrum about a second axis parallel to the first axis. The wedge is disposed between the trough and the pivoted bed. The actuator drives the wedge between the trough and the bed to rotate the trough in relation to the first fulcrum and bend the pipe seated in the trough against the pipe bending face of the die. The linkage applies force from the actuator to the wedge in a direction parallel to a longitudinal axis of the trough as the trough longitudinal axis rotates in relation to the first fulcrum.

Preferably, the pipe bending face is on a downstream portion of the die as the pipe is longitudinally transferred through the machine. The first fulcrum is downstream of the upstream portion of the pipe bending face and facilitates rotation about the first axis and perpendicular to the longitudinal axis of the pipe. The second fulcrum is downstream of the first fulcrum and facilitates rotation about a second axis parallel to said first axis.

According to the method for bending the pipe, the pipe is positioned in the trough which extends longitudinally downstream of the die for application by the die of a first force to one side of the pipe. A second force is exerted in a direction parallel to a longitudinal axis of the portion of the pipe positioned in the trough. The second force is converted into a third force applied to the longitudinal trough on the opposite side of the pipe than and downstream of the first force to bend the pipe against the first force. The third force is maintained in perpendicular relationship to the longitudinal axis of the portion of the pipe positioned in the trough as the pipe is bending against the die. If the pipe is to be bent in incremental steps, the pipe is then repositioned for application of the first force downstream of the previous application of the first force and the previous steps are repeated.

Preferably, the step of maintaining the third force perpendicular to the longitudinal axis of the portion of the pipe positioned in the trough is accomplished by the sub-steps of maintaining the second force parallel to the longitudinal axis of the portion of the pipe positioned in the trough as the pipe is bending against the die and maintaining the third force perpendicular to the second force.

Preferably, the pipe is fed longitudinally with respect to a fixed die and a trough, the trough being pivoted on a fulcrum on an upstream portion of the trough. Feeding of the pipe is stopped at a position in which a leading portion of the pipe is aligned with the trough on one side and a trailing portion of the pipe is aligned with the die on an opposite side. The wedge is driven between the downstream portion of the trough and the bed to pivot the trough about the fulcrum and bend the pipe against the die.

Preferably, the step of driving the wedge is accomplished by the sub-steps of exerting a force on the wedge in a direction parallel to a longitudinal axis of the portion of the pipe seated in the trough and maintaining the exerted force in parallel relationship to the longitudinal axis of the portion of the pipe seated in the trough as the pipe is bending against the die.

If the pipe is to be bent in incremental steps, the pipe is fed further in the downstream direction. The further feeding of the pipe is stopped at a second position in which a leading portion of the pipe is aligned with the trough on one side and a trailing portion of the pipe is aligned with the die on an opposite side. The wedge is driven between the downstream portion of the trough and the bed to pivot the trough about the fulcrum and bend the pipe against the die. The steps of feeding, stopping and driving at predetermined incremental positions along the pipe are sequentially repeated until the bend is completed.

A pipe bender in accordance with this invention reduces the required hydraulic force by a factor in a range of 4:1 in comparison to known pipe bending machines. It reduces the forces exerted by the cylinder and the opportunity for leaks and defects. It puts the cylinders in a linear non-competing, non-binding configuration.

BRIEF DESCRIPTION OF THE DRAWINGS

Other objects and advantages of the invention will become apparent upon reading the following detailed description and upon reference to the drawings in which.

While the invention will be described in connection with a preferred embodiment thereof, it will be understood that it is not intended to limit the invention to that embodiment or to the details of the construction or the arrangement of parts illustrated in the accompanying drawings.

DETAILED DESCRIPTION

Figure 1:
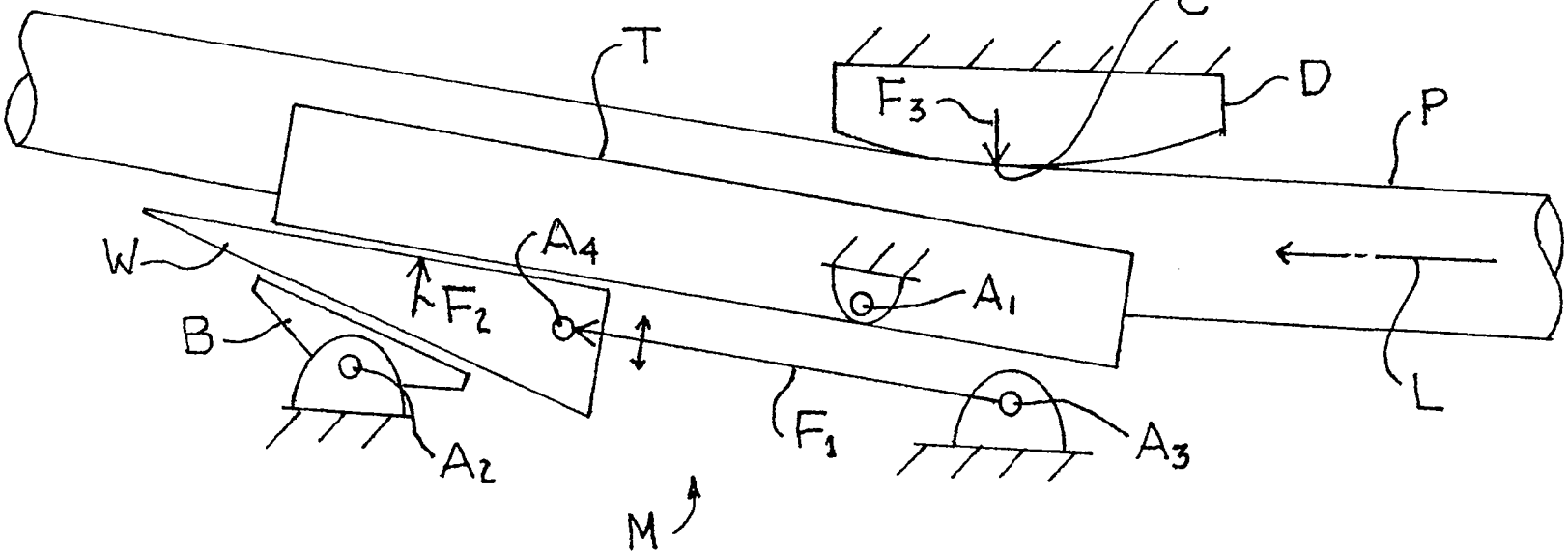
FIG. 1 is a free-body diagram of the operating components of the pivoting wedge pipe bending machine.
Figure 2:
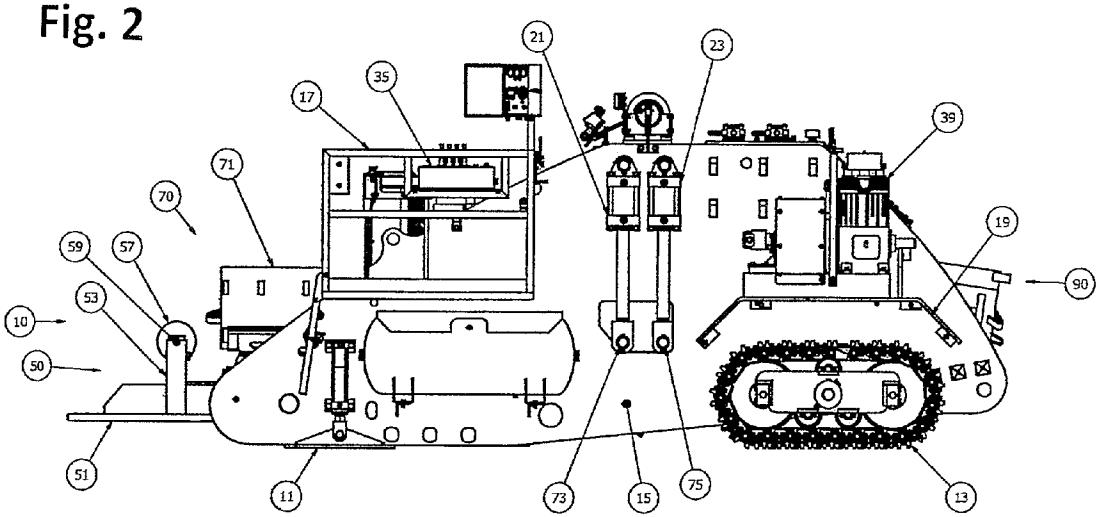
FIG. 2 is a left side elevation view of the pivoting wedge pipe bending machine with the stiff-back in a fully lowered condition.
Figure 3:
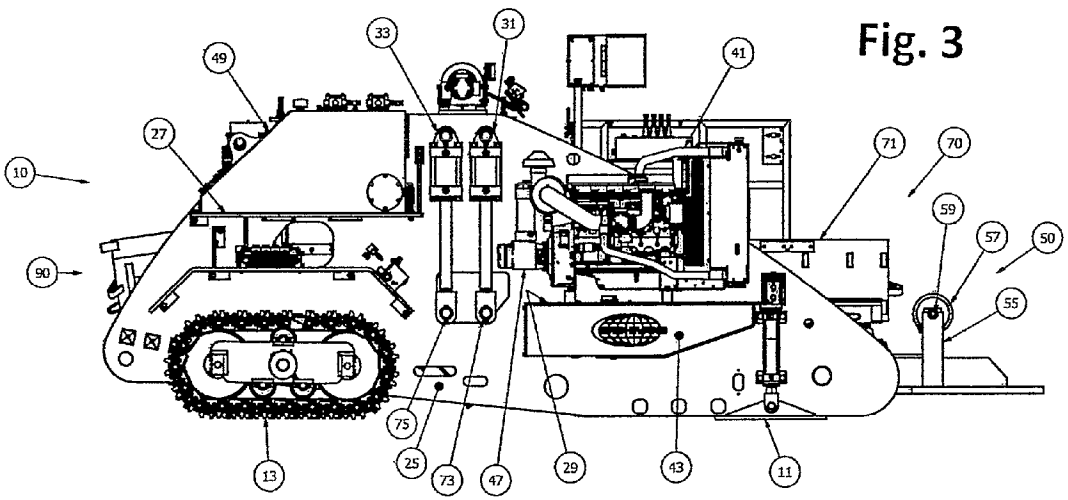
FIG. 3 is a right side elevation view of the pivoting wedge pipe bending machine with the stiff-back in a fully lowered condition.

Turning first to FIG. 1, the pipe P is to be bent against a die D. The pipe P will be advanced along its longitudinal axis L in a downstream direction in incremental steps past the die D. "Downstream direction" is relative and describes the movement of the pipe P in relation to the machine M. In practice, the machine M moves upstream in relation to the pipe P which is stationary. The pipe P is initially advanced to a position at which it can be rested in a trough T, commonly referred to as a stiff-back, which extends longitudinally downstream of the die D. The trough T is pivoted on a first axis $A_1$, as shown on the upstream portion of the trough T below the die D but downstream of the anticipated contact point C of the pipe P with the die D. The downstream end of the trough T is supported by a wedge W which is supported by and reciprocally slides on a bed B which is pivoted on a second axis $A_2$. When the pipe P is in the initial position, a wedge driving force $F_1$ which is directionally variable in relation to a third axis $A_3$ is applied at a fourth pivotal axis $A_4$ to the wedge W in a direction parallel to the longitudinal axis L of the pipe P and the trough T. This results in a trough lifting force $F_2$ being exerted on the trough T in a direction perpendicular to the wedge driving force $F_1$ applied to the wedge W. The application of the lifting force $F_2$ to the free end of the trough T bends the pipe P against the opposing force $F_3$ of the die D to conform the portion of the pipe P downstream of the contact point C to the shape of die D. As the sliding of the wedge W between the bed B and the trough T causes the trough to rotate about its pivotal axis $A_1$, the direction of the longitudinal force $F_1$ changes. However, the bed B and the wedge W pivot on their respective axes $A_2$ and $A_4$ to maintain the force $F_2$ perpendicular to the longitudinal axis L of the pipe P and trough T as the pipe P is bending against the die D. After being bent to the desired contour in initial position, the pipe P will be advanced along its longitudinal axis L in the downstream direction in incremental steps past the die D, repositioning the pipe P for application of the bending force $F_2$ downstream of the previous application of the bending force $F_2$. The steps are repeated until bending of the pipe P has been completed.

Turning now to FIGS. 2-7, a preferred embodiment of the machine 10 has a chassis 11 mounted on a pair of idler tracks 13. One side plate 15, as shown on the left side of the machine 10, supports an operator platform 17, a pneumatics platform 19 and inboard hydraulic cylinders 21 and 23. Another side plate 25, as shown on the right side of the machine 10, supports an hydraulics platform 27, a power system platform 29 and inboard hydraulic cylinders 31 and 33. Looking at the left side plate 15 in FIGS. 2, 4, 5 and 6, a bender operation control box 35 is mounted on the operator platform 17. An air tank 37 is mounted below and an air compressor 39 is mounted on the pneumatics platform 19. Looking at the right side plate 25 in FIGS. 3, 4, 5 and 7, the engine 41 is mounted on and the fuel tank 43 is mounted under the power system platform 29. The engine control box 45 is mounted on the operator platform 17 on the left side plate 15. An hydraulic pump 47 is mounted behind the engine 41 and an hydraulic tank 49 is mounted on the hydraulic platform 27.

Figure 5:
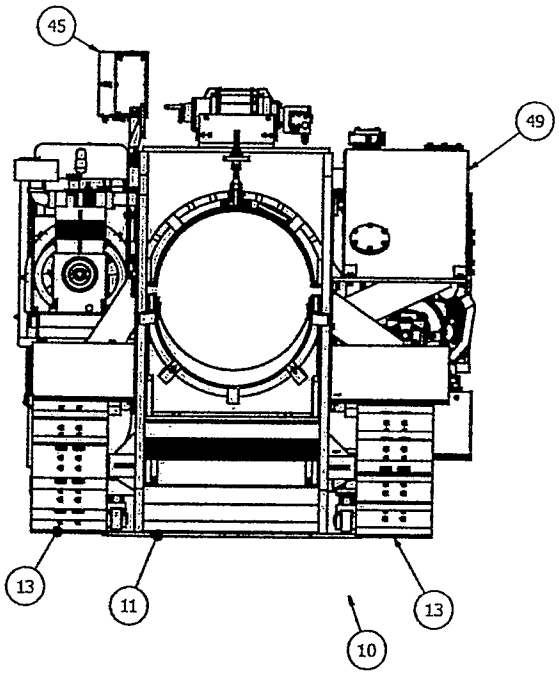
FIG. 5 is a rear elevation view of the pivoting wedge pipe bending machine with the stiff-back in a fully lowered condition.
Figure 4:
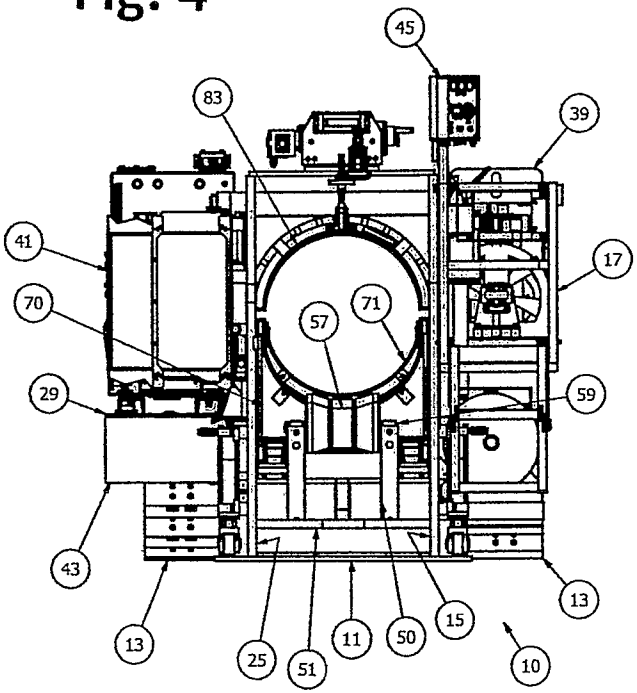
FIG. 4 is a front elevation view of the pivoting wedge pipe bending machine with the stiff-back in a fully lowered condition.
Figures 6, 7:
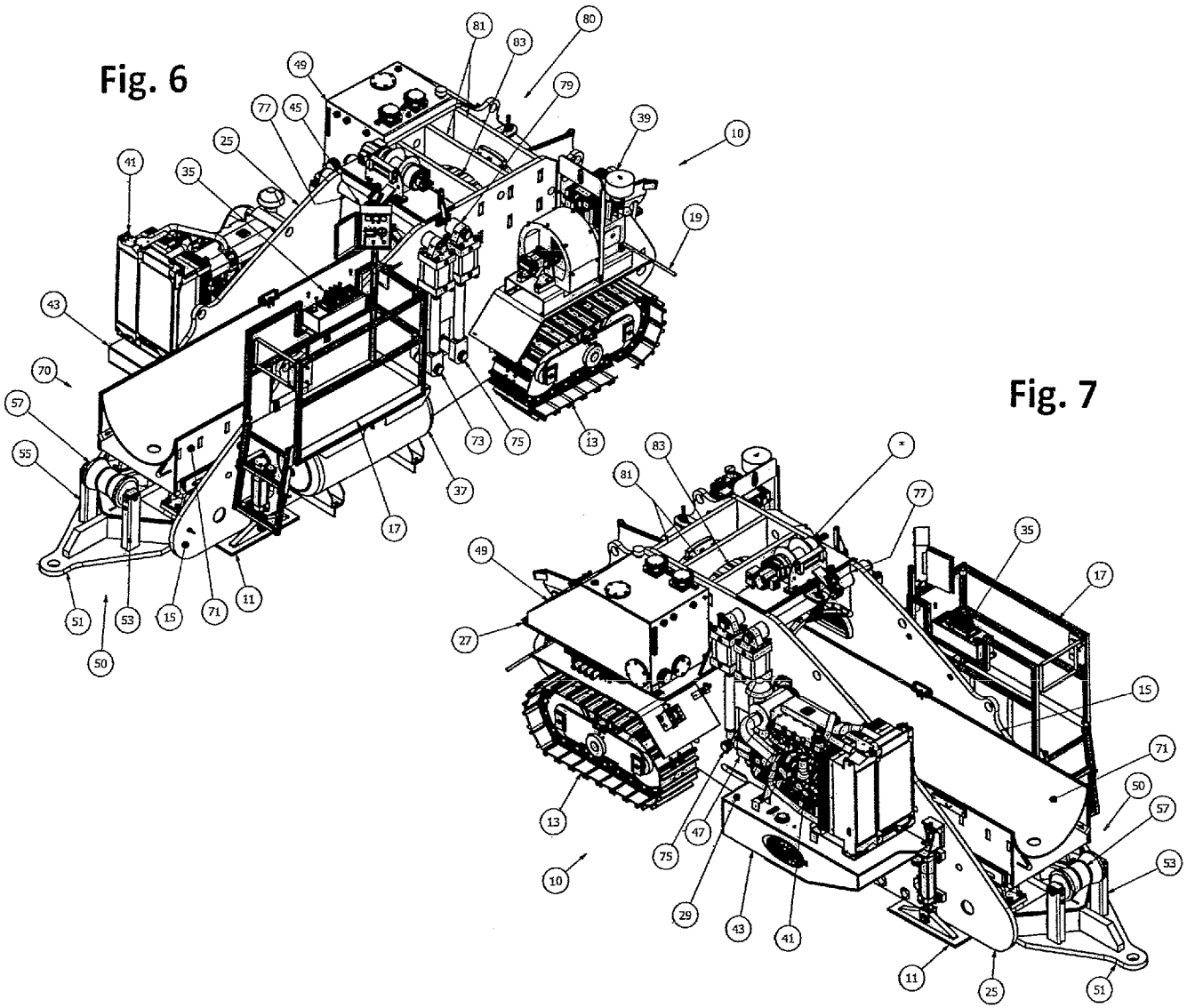
FIG. 6 is a perspective view of the front, top and left sides of the pivoting wedge pipe bending machine with the stiff-back in a fully lowered condition.
FIG. 7 is a perspective view of the front, top and right sides of the pivoting wedge pipe bending machine with the stiff-back in a fully lowered condition.
Figure 8:
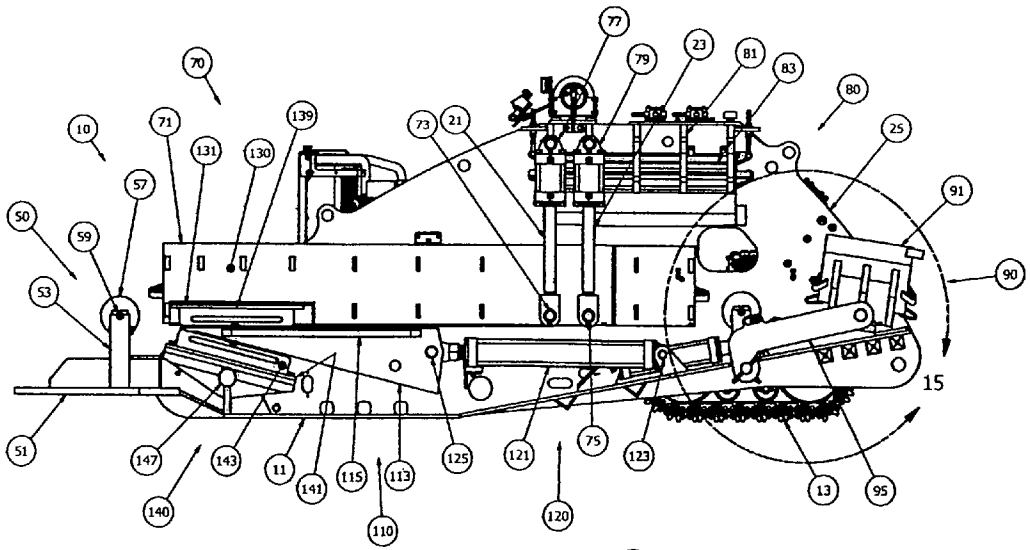
FIG. 8 is a left side elevation view of the pivoting wedge pipe bending machine with the side plate removed and the stiff-back in a fully lowered condition.
Figure 9:
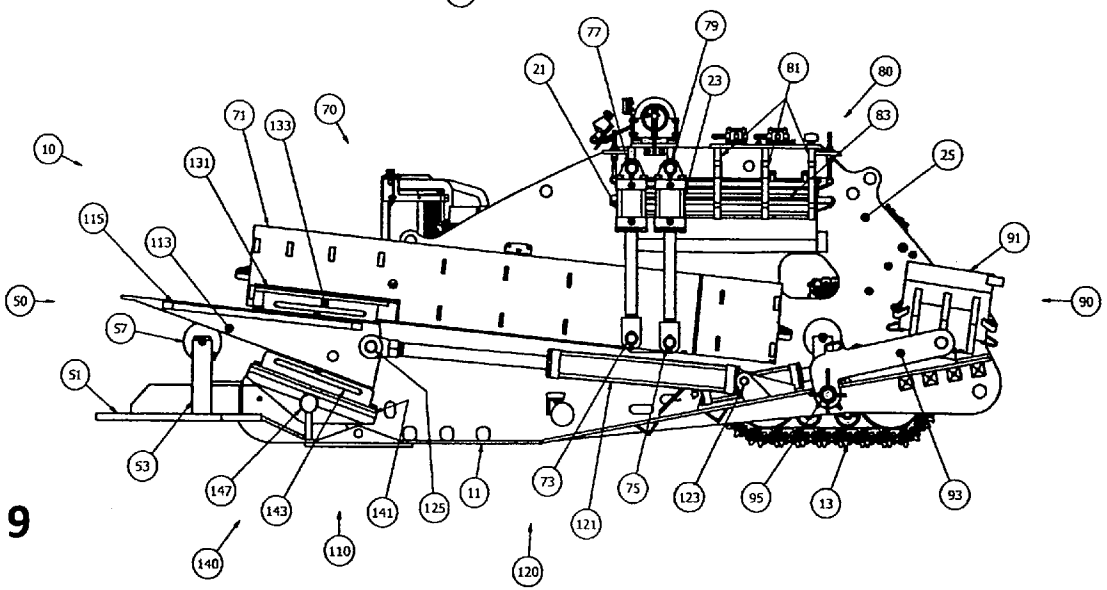
FIG. 9 is a left side elevation view of the pivoting wedge pipe bending machine with the side plate removed and the stiff-back in a fully raised condition.

The interior components of the machine 10 mounted between the side plates 15 and 25 are illustrated in FIGS. 4 and 5 and in FIGS. 8 and 9 in which the left side plate 15 and its associated platforms and exterior components are removed, except for the inboard cylinders 21 and 23. The inboard components include front and rear pipe receiving roller assemblies 50 and 60, respectively, the stiff-back assembly 70, the die assembly 80, the pin-up clamp assembly 90 and the wedge drive assembly 100.

The front pipe receiving roller assembly 50 includes a forward extension 51 of the chassis 11 with uprights 53 and 55 supporting a front roller 57 on an axle 59. The rear pipe receiving assembly 60, best seen in FIGS. 10 and 11, includes uprights 63 and 65 from the chassis 11 supporting a rear roller 67 on an axle 69.

The stiff-back assembly 70 includes the trough or stiff-back 71 which is supported proximate its rearward end by the inboard hydraulic cylinders 21, 23, 31 and 33 which are pivotally connected on the stiff-back lugs 73 and 75 (right side lugs 73 and 75 not shown), respectively, and to the suspension shafts 77 and 79, respectively, extending through the die assembly 80.

Figures 10, 11:
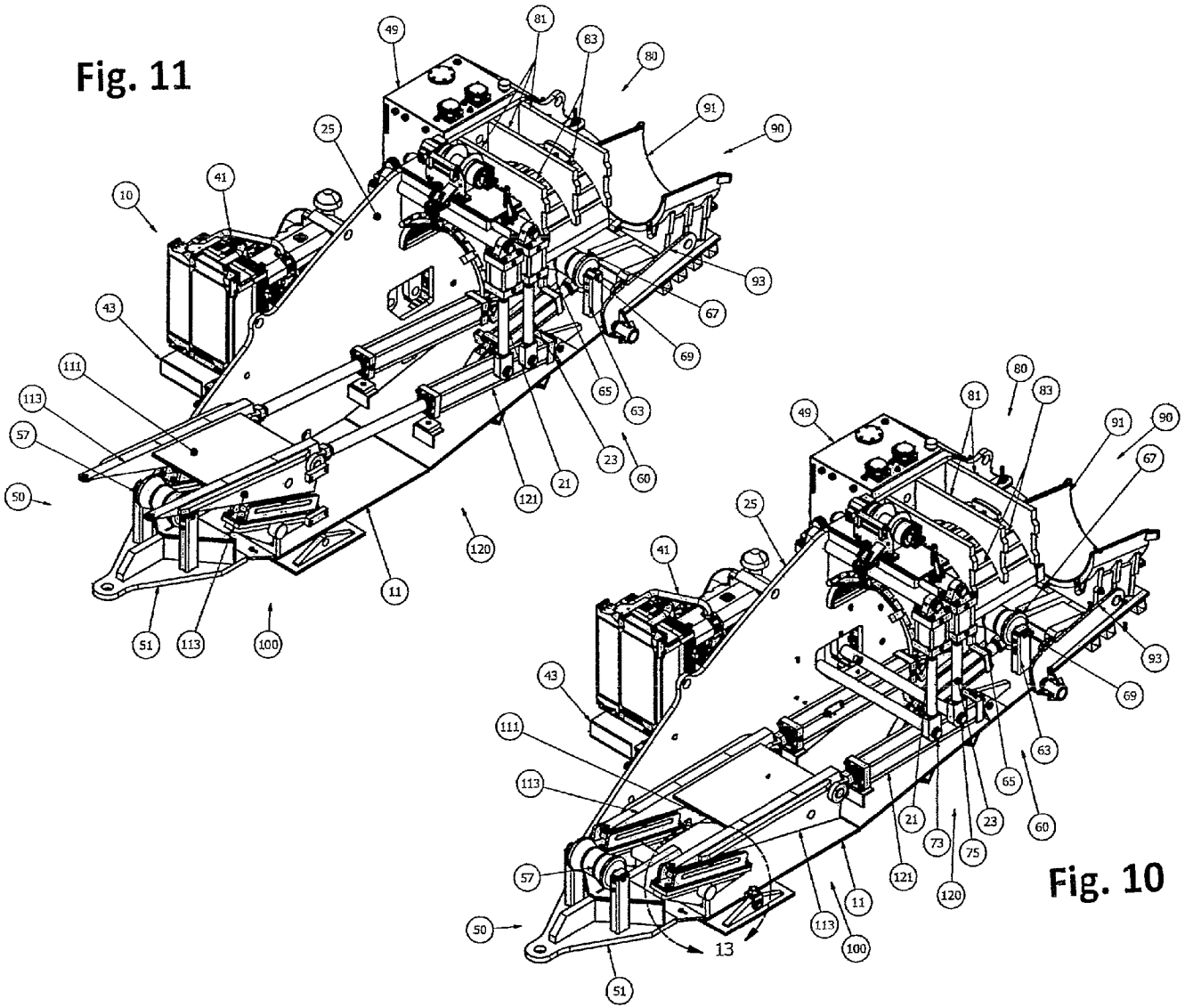
FIG. 10 is a perspective view of the pivoting wedge pipe bending machine with the side plate and stiff-back removed and the wedge in a fully retracted condition.
FIG. 11 is a perspective view of the pivoting wedge pipe bending machine with the side plate and stiff-back removed and the wedge in a fully extended condition.
Figure 15:
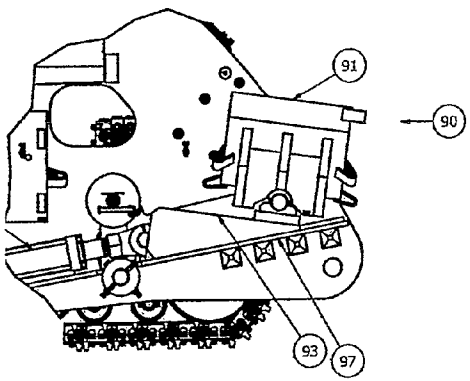
FIG. 15 is a perspective view of the rear, top and left sides of the pin-up clamp assembly of the pivoting wedge pipe bending machine.

The die assembly 80, best seen in FIGS. 10 and 11, includes nesting plates 81 securing the die bars 83 in shape and position to bear against the pipe in the bending process. The pin up clamp assembly 90, best seen in FIG. 15, includes a short trough or clamp 91. A pin-up wedge 93 is positioned between the clamp 91, which is guided by left and right arms 95 (right side arm 95 not shown), and a slide 97. The wedge 93 is reciprocally driven by a pin-up hydraulic cylinder 99 pivotally mounted on the chassis 11 to raise and lower the clamp 91 between the guide arms 95 toward and away from the die assembly 80.

Figure 12:
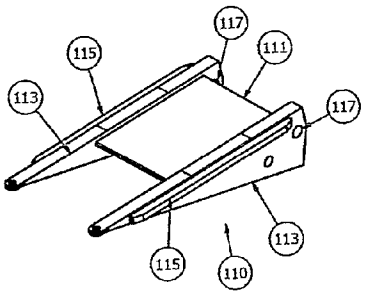
FIG. 12 is a perspective view of the wedge assembly of the pivoting wedge pipe bending machine.

The wedge drive assembly 100, best seen in FIGS. 8-11, includes a wedge assembly 110, left and right outboard hydraulic driving cylinder assemblies 120, left and right stiff-back lift roller assemblies 130 and left and right roller pivot clamp assemblies 140. The wedge assembly 110, shown in greater detail in FIG. 12, includes a support plate 111 connected along the hypotenuse edges of opposed side plates 113. Guides 115, as shown with chamfered leading ends and extending on the outboard sides of the wedge assembly side plates 113 parallel to the support plate 111, are provided to keep the wedge assembly 110 centered in the bender chassis 11 between the machine side plates 15 and 25. Holes 117 are provided in the trailing ends of the wedge side plates 113 for connecting the wedge assembly 110 to the driving cylinder assemblies 120. Each of the driving cylinder assemblies 120 includes a driving cylinder 121 pivotally mounted at its rearward end to the chassis 11 on an axle 123. The forward end of each driving cylinder 121 is pivotally connected to the wedge assembly 110 by a pin 125 through its corresponding hole 117 in the wedge assembly 110. The leading end of the wedge assembly 110 slides reciprocally between the stiff-back lift roller assemblies 130 and the roller pivot clamp assemblies 140 in response to the extension and retraction of the driving cylinders 121, as best seen in FIGS. 8 and 9.

Figure 13:
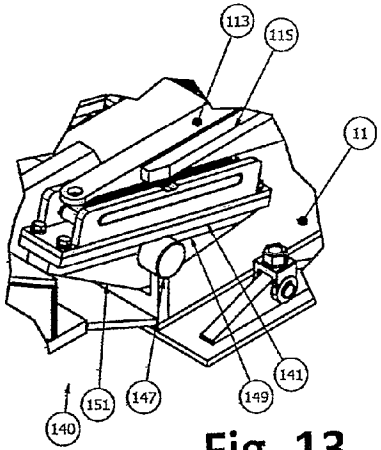
FIG. 13 is an enlarged view of the area 13 of FIG. 11.
Figure 14:
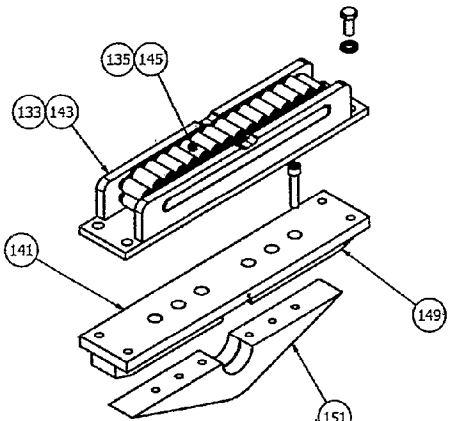
FIG. 14 is a perspective assembly view of the pivot roller clamp assembly of the pivoting wedge pipe bending machine.

Continuing to look at FIGS. 8 and 9, each stiff-back lift roller assembly 130 includes a platform 131 seated on the wedge assembly 110 and supporting the forward portion of the stiff-back 71. Looking at FIG. 14, channel guides 133 have rollers 135 forming tracks in the channel guides 133. Returning to FIGS. 8 and 9, one guide 133 on each side of the underside of the platform 131 receives the upper edges of the wedge assembly side plates 113 onto the rollers 135. Turning to FIGS. 13 and 14, each roller pivot clamp assembly 140 includes a platform 141 and a channel guide 143 with rollers 145 forming a track in the channel guide 141. The channel guide 143 is mounted on top of its platform 141 and receives the lower edges of the wedge assembly side plates 113 under the rollers 145. A shaft 147 engaged in a bushing formed by upper and lower clamp members 149 and 151, respectively, pivotally supports the roller pivot clamp assembly 140 on the chassis 11.

The operation of the machine can best be understood in reference to FIGS. 8-11. FIGS. 8 and 10 show the stiff-back 71 in a fully lowered condition in which the inboard hydraulic cylinders 21, 23, 31 and 33 are fully extended and the outboard hydraulic wedge driving cylinders 121 are fully retracted. FIGS. 9 and 11 show the stiff-back 71 in a fully raised condition in which the inboard hydraulic cylinders 21, 23, 31 and 33 are fully retracted and the outboard hydraulic wedge driving cylinders 121 are fully extended.

In operation, the bending process begins with the inboard hydraulic cylinders 21, 23, 31 and 33 fully extended and the outboard 121 hydraulic cylinders fully retracted, as seen in FIG. 8. The pipe is generally, though not always, pushed into the machine 10 via its back end. A mandrel (not shown) aligned and sitting in the stiff-back 71 is inserted into the pipe to maintain the pipe circularity during bending. The air tank 37 and compressor 39 of the machine 10 are intended to serve a pneumatic mandrel used for this purpose. As The pipe is loaded into the machine 10, it passes across the rear roller 67 and onto the front roller 57 and eventually rests on the rollers 67 and 57 and above the stiff-back 71. As the pipe is loaded, it is marked to identify the points along the pipe at which "pulls" will be sequentially made, it generally taking multiple "pulls" to achieve a full bend.

Once the marked pipe is positioned for the first bend, the inboard hydraulic cylinders 21, 23, 31 and 33 are operated to retract lightly until the stiff-back 71 raises the pipe into contact with the die bars 83. The die bars 83 arc across their length so that the pipe substantially makes linear contact across the width of the die assembly 80. When contact is made, retraction is terminated with contact being maintained. The pin-up hydraulic cylinder 99 is then actuated to drive the pin-up wedge 93 between the guide arms 95 and raise the clamp 91 toward the die assembly 80 to pin the pipe against the die bars 83 along the linear contact line. The pin-up hydraulic cylinder 99 is de-actuated with the pipe in the pinned-up condition.

The outboard hydraulic driving cylinders 121 are then actuated to drive the wedge assembly 110 forwardly between the rollers 135 of the stiff-back lift roller assemblies 130 and the rollers 145 of the pivot clamp assemblies 140. The stiff-back lift roller assemblies 130, including its platform 131, are raised as the wedge assembly 110 is driven against the pivoted platforms 141 of the pivot clamp assemblies 140, thus raising the stiff-back 71 about the stiff-back pivot lugs 73 and 75 and the suspension shafts 77 and 79 to bend the pipe against the die bars 83. Pivoting the inboard cylinders 21, 23, 31 and 33 on the suspension shafts 77 and 79 allows inboard cylinders 21, 23, 31 and 33 to operate without competing against each other. Pivoting the stiff-back 71 on the lugs 73 and 75 allows the stiff-back to assume the orientation necessary to conform to the orientation of the pipe. Since the stiff-back 71 is parallel to the roller assembly platform 131 supporting it, the driving force of the extending outboard hydraulic driving cylinders 121 is applied to the wedge assembly 110 in a direction parallel to the stiff-back 71 and the pipe. Since the platforms 141 supporting the wedge assembly 110 are pivoted, the driving force remains parallel to the stiff-back 71 even though the stiff-back 71 is rotating about the lugs 75. Thus, the lifting force applied by the wedge assembly 110 to the stiff-back 71 remains perpendicular to the direction of the driving force of the outboard cylinders 121 and remains constant even though the alignment of the pivoting outboard cylinders 121 varies as the pipe is bending against the die bars 83.

After the first bend is completed, the pin-up cylinder 99 is actuated to withdraw the pin-up wedge 93 and return the pin-up clamp 91 to its lowest position, the outboard cylinders 121 are fully retracted and the inboard cylinders 21, 23, 31 and 33 are fully extended to lower the stiff-back 71 and return the pipe to the front and rear rollers 57 and 67. The pipe will then be advanced to the next mark and the preceding steps repeated until bending of the pipe at all of the marks has been completed.

A pipe bending machine according to the present invention will typically afford a mechanical advantage in a range of 4:1 in comparison to known pipe bending machines. This mechanical advantage reduces the forces exerted by the driving cylinders 121. In some applications, mechanical advantages in a range of 6:1 are possible, depending on the coefficient of friction of the rollers 135 and 145 and the geometry of the wedge assembly 110. The opportunity for leaks and defects is decreased, the cylinders 121 operate in a linear non-competing, non-binding configuration and the cylinders 121 are reduced to standard commercially available sizes.

Thus it is apparent that there has been provided, in accordance with invention, a pipe bending machine that fully satisfies the objects, aims and advantages set forth above. While the invention has been described in conjunction with a specific embodiment thereof, it is evident that many alternatives modifications and variations will be apparent to those skilled in the art in light of the foregoing description. Accordingly, it is intended to embrace all such alternatives, modifications and variations as fall within the spirit of the appended claims.

What is claimed is:

1. A method for bending pipe comprising the steps of: feeding the pipe longitudinally with respect to a fixed die and a trough, the trough being pivoted on a fulcrum on an upstream portion of the trough; stopping feeding of the pipe at a position in which a leading portion of the pipe is aligned with the trough on one side and a trailing portion of the pipe is aligned with the die on an opposite side; and driving a wedge between a downstream portion of the trough and a bed to pivot the trough about the fulcrum to cause the pipe to bend against the die.

2. A method according to claim 1, said step of driving the wedge comprising the sub-steps of:

exerting a force on the wedge in a direction parallel to a longitudinal axis of the portion of the pipe seated in the trough; and maintaining the exerted force in parallel relationship to the longitudinal axis of the portion of the pipe seated in the trough as the pipe is bending against the die.

3. A method according to claim 1 further comprising the steps of:

feeding the pipe further in the downstream direction;

stopping further feeding of the pipe at a second position in which a leading portion of the pipe is aligned with the trough on one side and a trailing portion of the pipe is aligned with the die on an opposite side; and driving the wedge between the downstream portion of the trough and the bed to pivot the trough about the fulcrum and bend the pipe against the die.

4. A method according to claim 3 further comprising the steps of sequentially repeating the feeding, stopping and driving steps at predetermined incremental positions along the pipe.

* * * * *